US011982290B2

(12) United States Patent
Thobias et al.

(10) Patent No.: US 11,982,290 B2
(45) Date of Patent: May 14, 2024

(54) HOUSING FOR FORWARD CURVED BLOWER

(71) Applicant: Lennox Industries Inc., Richardson, TX (US)

(72) Inventors: Patric Ananda Balan Thobias, Chennai (IN); Vinoth Kumar Settu, Ponmar (IN); Prabhu Prakasam, Chennai (IN); Sangameshwaran Sadhasivam, Kancheepuram (IN)

(73) Assignee: Lennox Industries Inc., Richardson, TX (US)

( * ) Notice: Subject to any disclaimer, the term of this patent is extended or adjusted under 35 U.S.C. 154(b) by 252 days.

(21) Appl. No.: 17/451,768

(22) Filed: Oct. 21, 2021

(65) Prior Publication Data

US 2023/0128902 A1 Apr. 27, 2023

(51) Int. Cl.
*F04D 29/42* (2006.01)
*F04D 29/28* (2006.01)
*F04D 29/30* (2006.01)

(52) U.S. Cl.
CPC ..... *F04D 29/4226* (2013.01); *F04D 29/281* (2013.01); *F04D 29/30* (2013.01)

(58) Field of Classification Search
CPC ..... F04D 29/281; F04D 29/4226
See application file for complete search history.

(56) References Cited

U.S. PATENT DOCUMENTS 6,439,839 B1 * 8/2002 Song ..... F04D 29/441 415/206
9,745,983 B2 * 8/2017 Pihet ..... F04D 17/10
2021/0199125 A1 * 7/2021 Teramoto ..... F04D 29/441

OTHER PUBLICATIONS

Extended European Search Report, Application No. 22197765.5, dated Feb. 23, 2023.

* cited by examiner

*Primary Examiner* — Sabbir Hasan
(74) *Attorney, Agent, or Firm* — Baker Botts L.L.P.

(57) ABSTRACT

A blower of an HVAC system includes an air inlet, an air outlet, a blower wheel with blades, a motor operable to cause the blower wheel to rotate, and a blower housing within which the blower wheel is positioned. The blower housing includes a top panel, a bottom panel, and a connecting panel. The top panel and the bottom panel are connected to the connecting panel. The top panel includes a curved edge extending from a bottom edge of the connecting panel to a top edge of the connecting panel. An expansion angle of the curved edge of the top panel changes as a function of position along the curved edge of the top panel. The bottom panel may have a shape corresponding to a mirror image to that of the top panel.

18 Claims, 5 Drawing Sheets

HOUSING FOR FORWARD CURVED BLOWER

TECHNICAL FIELD

The present disclosure relates generally to heating, ventilation, and air conditioning (HVAC) systems and methods of their use. In particular, the present disclosure relates to a housing for a forward curved blower.

BACKGROUND

Heating, ventilation, and air conditioning (HVAC) systems are used to regulate environmental conditions within an enclosed space. Air is cooled via heat transfer with refrigerant flowing through the HVAC system and returned to the enclosed space as cooled conditioned air. HVAC systems include fans or blowers that circulate air between the HVAC system and the enclosed space.

SUMMARY OF THE DISCLOSURE

This disclosure provides technical solutions to the problems of previous blower technology used in HVAC systems. For instance, previous HVAC blowers often sacrifice performance to achieve a desired small size to satisfy existing size constraints. This disclosure provides an improved blower for an HVAC system. For example, the housing of the blower may be sized and/or shaped differently to improve performance. For instance, the expansion angle at a curved edge of the housing may change as a function of angular position along the edge. In some cases, different sections of the housing may have an expansion angle that is selected to improve overall blower performance, for example, such that a larger expansion angle is provided in the section that plays the largest role in pressurizing received air. For instance, a first section of the blower housing that plays a limited role in pressurizing received air may have a relatively low expansion angle, while a second section of the housing that plays a larger role in air pressurization has a larger expansion angle to improve performance. This disclosure recognizes that the second section of the blower plays an important role in converting rotational velocity of a blower wheel of the blower to increasing pressure of air. Embodiments of the new blower housing of this disclosure provides improved blower performance, including improved efficiency, while maintaining the size of the blower. As such, blowers of this disclosure may be employed not only in new systems but also used to upgrade existing HVAC systems and improve performance.

Certain embodiments may include none, some, or all of the above technical advantages. One or more other technical advantages may be readily apparent to one skilled in the art from the figures, descriptions, and claims included herein.

In an embodiment, a blower for a heating, ventilation and air conditioning (HVAC) system includes an air inlet, an air outlet, a blower wheel with blades, a motor operable to cause the blower wheel to rotate, and a blower housing within which the blower wheel is positioned. The blower housing includes a top panel, a bottom panel, and a connecting panel. The top panel and the bottom panel are connected to the connecting panel. The top panel includes a curved edge extending from a bottom edge of the connecting panel to a top edge of the connecting panel. An expansion angle of the curved edge of the top panel changes as a function of position (e.g., angular position, θ, see FIGS. 3A,B and corresponding description below) along the curved edge of the top panel. The bottom panel may have a shape corresponding to a mirror image of that of the top panel.

BRIEF DESCRIPTION OF THE DRAWINGS

For a more complete understanding of the present disclosure, reference is now made to the following description, taken in conjunction with the accompanying drawings, in which.

DETAILED DESCRIPTION

Embodiments of the present disclosure and its advantages are best understood by referring to FIGS. 1-4 of the drawings, like numerals being used for like and corresponding parts of the various drawings.

As described above, prior to this disclosure, blowers for HVAC systems sacrificed performance to achieve sizes appropriate for use in the space available for HVAC system installation. The improved blower described in this disclosure provides improved performance while operating within the same or similar size constraints. As described in greater detail with respect to FIGS. 3A,B and 4, a section (or sections) of the blower housing that plays a larger role in determining blower performance may be larger (e.g., with an increased expansion angle), while other sections may be smaller (e.g., with smaller expansion angle). This allows overall blower size to be maintained within existing constraints (or even reduced), while blower performance is improved.

HVAC System

Figure 1:
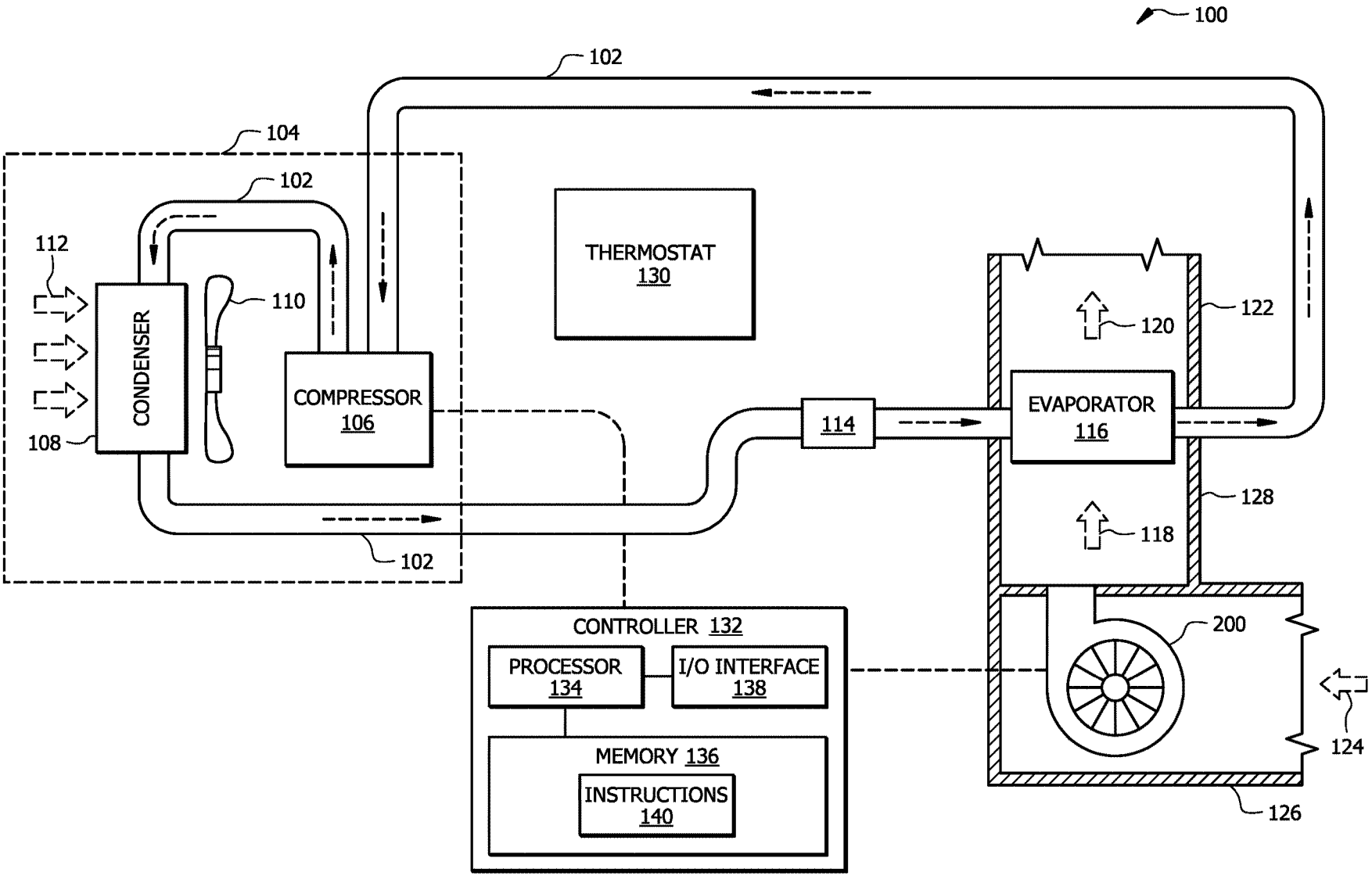
FIG. 1 is a diagram of an example HVAC system with the improved blower of this disclosure.

FIG. 1 is a schematic diagram of an example HVAC system 100 with the improved blower 200 of this disclosure. The HVAC system 100 conditions air for delivery to a space. The space may be, for example, a room, a house, an office building, a warehouse, or the like. In some embodiments, the HVAC system 100 is a rooftop unit (RTU) that is positioned on the roof of a building, and conditioned air 120 is delivered to the interior of the building. In other embodiments, portion(s) of the HVAC system 100 may be located within the building and portion(s) outside the building. The HVAC system 100 may be configured as shown in FIG. 1 or in any other suitable configuration. For example, the HVAC system 100 may include additional components or may omit one or more components shown in FIG. 1.

The HVAC system 100 includes a working-fluid conduit subsystem 102, a compressor unit 104, an expansion device 114, an evaporator 116, the blower 200, one or more thermostats 130, and a controller 132. The working-fluid conduit subsystem 102 facilitates the movement of a refrigerant through a refrigeration cycle such that the refrigerant flows as illustrated by the dashed arrows in FIG. 1. The working-fluid conduit subsystem 102 includes conduit, tubing, and the like that facilitates the movement of refrigerant between components of the HVAC system 100. The refrigerant may be any acceptable refrigerant including, but not limited to, fluorocarbons (e.g. chlorofluorocarbons), ammonia, non-halogenated hydrocarbons (e.g. propane), hydroflurocarbons (e.g. R-410A), or any other suitable type of refrigerant.

The HVAC system 100 includes a compressor unit 104 with a compressor 106, a condenser 108, and a fan 110. The compressor 106 is coupled to the working-fluid conduit subsystem 102 and compresses (i.e., increases the pressure of) the refrigerant. The compressor 106 may be a single-speed, variable-speed, or multiple stage compressor. The compressor 106 is in signal communication with the controller 132 using wired and/or wireless connection and is controlled by the controller 132. The condenser 108 is located downstream of the compressor 106 and is configured, when the HVAC system 100 is operating in a cooling mode, to remove heat from the refrigerant. The fan 110 is configured to move air 112 across the condenser 108. For example, the fan 110 may be configured to blow outside air through the condenser 108 to help cool the refrigerant flowing therethrough. In the cooling mode, the compressed, cooled refrigerant flows from the condenser 108 toward the expansion device 114.

The expansion device 114 is coupled to the working-fluid conduit subsystem 102 downstream of the condenser 108 and is configured to remove pressure from the refrigerant. The expansion device 114 may be a valve positioned in refrigerant conduit of the working-fluid conduit subsystem 102 that connects the condenser 108 to the evaporator 116. The refrigerant is delivered to the evaporator 116 and receives heat from airflow 118 to produce a conditioned airflow 120 that is delivered by a duct subsystem 122 to the conditioned space. The evaporator 116 is generally any heat exchanger configured to provide heat transfer between air flowing through (or across) the evaporator 116 (i.e., air 118 contacting an outer surface of one or more coils of the evaporator 116) and refrigerant passing through the interior of the evaporator 116, when the HVAC system 100 is operated in the cooling mode. The evaporator 116 is fluidically connected to the compressor 106, such that refrigerant generally flows from the evaporator 116 to the compressor 106.

Return air 124, which may be air returning from the building, air from outside, or some combination, is pulled into a return duct 126. An inlet or suction side of the blower 200 (e.g., corresponding to inlet(s) 208 of FIG. 2A) pulls the return air 124. The blower 200 discharges air 118 (e.g., corresponding to at least a portion of airflow 416 of FIG. 4) into a duct 128 such that air 118 crosses the evaporator 116 to produce conditioned air 120. In certain embodiments, the improved blower 200 of this disclosure provides a target rate of airflow 118 at a decreased input power than was possible using previous blower technology. The blower 200 is in signal communication with the controller 132 using any suitable type of wired and/or wireless connection. The controller 132 provides commands for controlling operation of the blower 200 (e.g., a speed at which the blower wheel 206 of the blower 200 rotates, see, e.g., FIG. 2A). The blower 200 is generally sized and shaped to fit within a predefined space determined by the properties of the HVAC system 100 and/or the environment in which it is installed (e.g., the space in and/or around duct 126 of the HVAC system 100). For example, the blower 200 may be sized to fit within the duct 126 as illustrated in FIG. 1. The blower 200 and its operation is described in greater detail below with respect to FIGS. 2A-D, 3A,B, and 4 below.

The HVAC system 100 may include one or more of the sensors in wired and/or wireless signal communication with controller 132. In some embodiments, one or more of the sensors may be integrated within components of the HVAC system 100 (e.g., the compressor 106, condenser 108, evaporator 116, blower 200, or the like). Sensors may be positioned and configured to measure properties associated with operation of the HVAC system 100 (e.g., the temperature and/or relative humidity of air at one or more locations within the conditioned space and/or outdoors, e.g., temperature and/or pressure of refrigerant in the HVAC system 100).

The HVAC system 100 includes one or more thermostats 130, for example, located within the conditioned space (e.g. a room or building). The thermostat(s) 130 are generally in signal communication with the controller 132 using any suitable type of wired and/or wireless connection. In some embodiments, one or more functions of the controller 132 may be performed by the thermostat(s) 130. The thermostat(s) 130 allow a user to input a desired temperature or temperature setpoint for the conditioned space and/or for a designated space or zone, such as a room, in the conditioned space. The thermostat(s) generally include or are in communication with or include a sensor for measuring an indoor air temperature. The controller 132 may use information from the thermostat 130 such as a temperature setpoint and/or indoor air temperature for controlling the compressor 106, the blower 200, and the fan 110.

The controller 132 includes a processor 134, memory 136, and input/output (I/O) interface 138. The processor 134 includes one or more processors operably coupled to the memory 136. The processor 134 is any electronic circuitry including, but not limited to, state machines, one or more central processing unit (CPU) chips, logic units, cores (e.g. a multi-core processor), field-programmable gate array (FPGAs), application specific integrated circuits (ASICs), or digital signal processors (DSPs) that communicatively couples to memory 136 and controls the operation of HVAC system 100. The processor 134 may be a programmable logic device, a microcontroller, a microprocessor, or any suitable combination of the preceding. The processor 134 is communicatively coupled to and in signal communication with the memory 136. The one or more processors are configured to process data and may be implemented in hardware or software. For example, the processor 134 may be 8-bit, 16-bit, 32-bit, 64-bit or of any other suitable architecture. The processor 134 may include an arithmetic logic unit (ALU) for performing arithmetic and logic operations, processor registers that supply operands to the ALU and store the results of ALU operations, and a control unit that fetches instructions from memory 136 and executes them by directing the coordinated operations of the ALU, registers, and other components. The processor 134 may include other hardware and software that operates to process information, control the HVAC system 100, including the blower 200. The processor 134 is not limited to a single processing device and may encompass multiple processing devices. Similarly, the controller 132 is not limited to a single controller but may encompass multiple controllers.

The memory 136 includes one or more disks, tape drives, or solid-state drives, and may be used as an over-flow data storage device, to store programs when such programs are selected for execution, and to store instructions and data that are read during program execution. The memory 136 may be volatile or non-volatile and may include ROM, RAM, ternary content-addressable memory (TCAM), dynamic random-access memory (DRAM), and static random-access memory (SRAM). The memory 136 is operable (e.g., or configured) to store information used by the controller 132, such as instructions 140, which includes any logic, code, rules for operating the HVAC system 100, including the blower 200 and performing the function described in this disclosure.

The I/O interface 138 is configured to communicate data and signals with other devices. For example, the I/O interface 138 may be configured to communicate electrical signals with components of the HVAC system 100 including the compressor 106, fan 110, expansion device 114, blower 200, and thermostat(s) 130. The I/O interface 138 may be configured to communicate with other devices and systems. The I/O interface 138 may provide and/or receive, for example, compressor speed signals blower speed signals, temperature signals, relative humidity signals, thermostat calls, temperature setpoints, environmental conditions, and an operating mode status for the HVAC system 100 and send electrical signals to the components of the HVAC system 100. The I/O interface 138 may send a signal to the motor 204 of the blower 200, causing the motor 204 to rotate the blower wheel 206 at a given rate (see FIG. 2A). The I/O interface 138 may include ports or terminals for establishing signal communications between the controller 132 and other devices. The I/O interface 138 may be configured to enable wired and/or wireless communications.

Example Blower

Figure 2A:
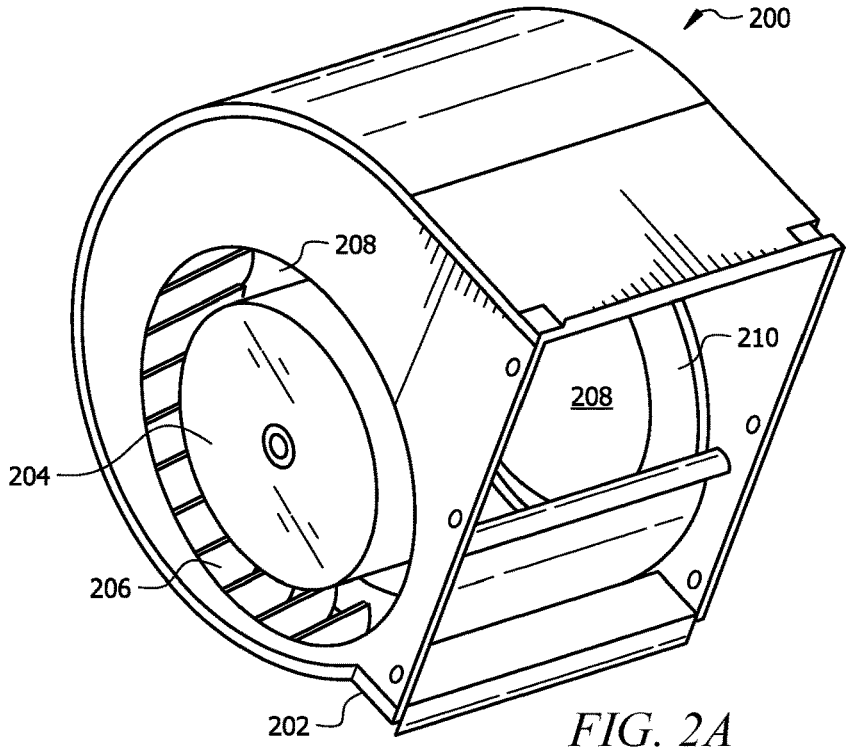
FIG. 2A is a diagram showing an example blower of the HVAC system of FIG. 1.

FIG. 2A illustrates an example of the improved blower 200 of this disclosure. The blower 200 includes a housing 202, a motor 204, and a blower wheel 206. The blower wheel 206 is positioned within the housing 202. The motor 204 is coupled to the blower wheel 206 and operable to cause the blower wheel 206 to rotate. The motor 204 may be a single-speed or variable speed motor. When the motor 204 causes the blower wheel 206 to rotate, air is pulled through one or more inlets 208 and expelled through the outlet 210. The outlet 210 may lead into duct 128 of FIG. 1 when the blower 200 is installed in HVAC system 100.

Figure 2B:
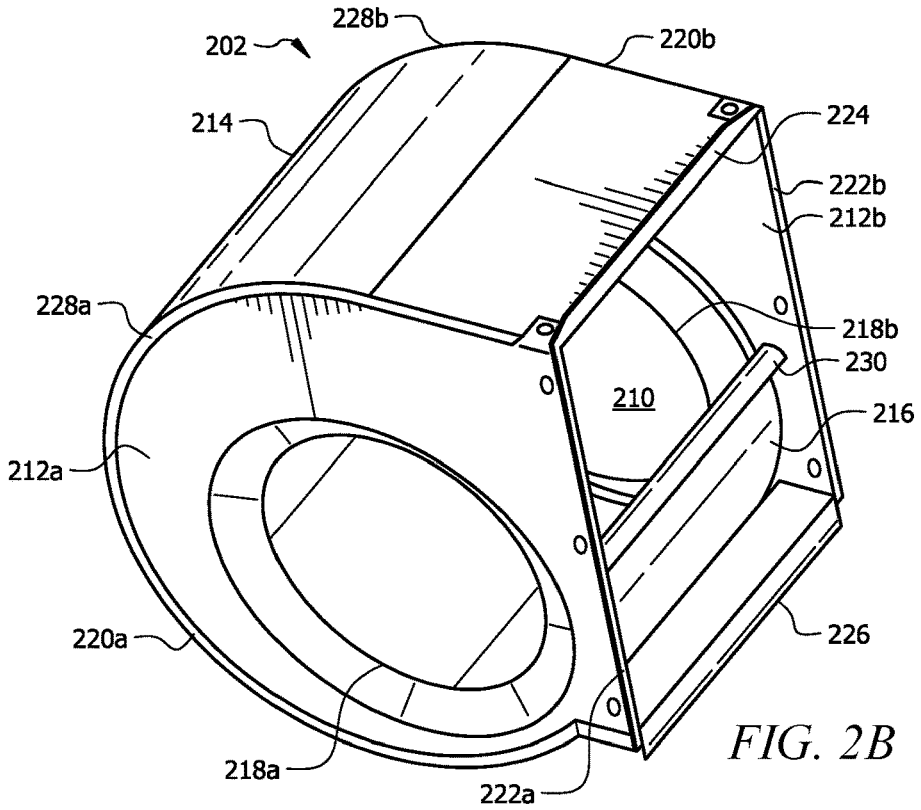
FIG. 2B is a diagram showing the housing of the blower of FIG. 2A.
Figure 2C:
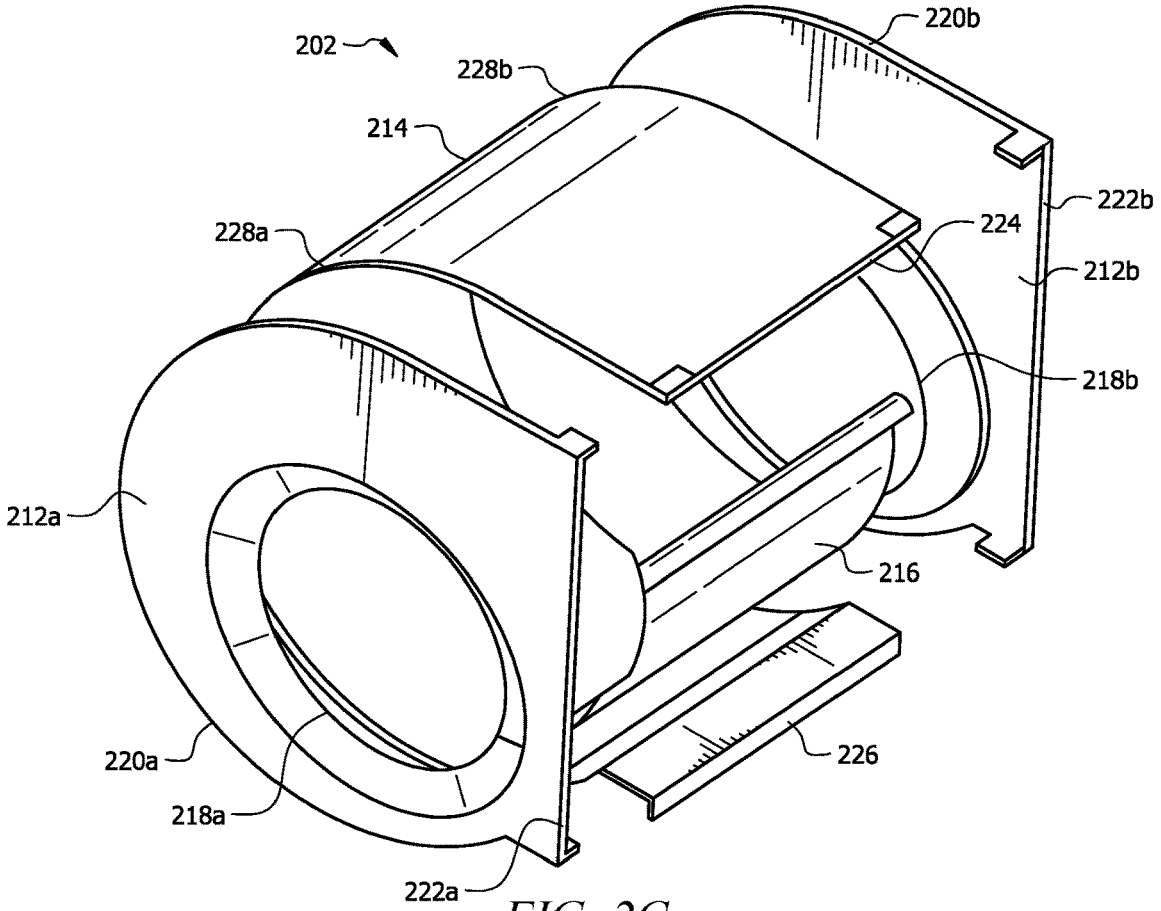
FIG. 2C is a diagram showing the housing of FIG. 2B when not completely assembled.

FIGS. 2B,C illustrates an example housing 202 in greater detail. FIG. 2B shows an assembled housing 202 (with motor 204 and blower wheel 206 not present). FIG. 2C shows an unassembled housing 200, such that various panels of the housing 202 can be viewed. As shown in FIGS. 2A,B, the blower housing 202 includes a top panel 212*a*, a bottom panel 212*b* (, and a connecting panel 214. Each of the panels 212*a,b*, 214 is generally a sheet of material (e.g., aluminum, stainless steel, or the like) shaped as illustrated in FIGS. 2A-C and described below. The top panel 212*a* and bottom panel 212*b* are connected to the connecting panel 214, as illustrated in FIGS. 2B,C, to form the housing 202. A cutoff plate 216 may be included that defines the dimensions of the outlet 210 of the blower 200. The cutoff plate 216 is another curved panel of material positioned within the blower housing 202. The outlet 210 is an opening defined by edges 222*a,b*, 224, and 230, as described further below. The blower housing 202 may include any appropriate adaptors or connectors to support mounting of the motor 204 and/or blower wheel 206 on, near, or within the housing 202, as illustrated in the example of FIG. 2A.

The top panel 212*a* and bottom panel 212*b* are sheets of material shaped as illustrated in FIGS. 2A-C with curved edges 220*a,b*, straight edges 222*a,b*, and openings 218*a,b*. The top panel 212*a* and bottom panel 212*b* each have a corresponding opening 218*a,b* that defines the inlets 208 of the blower 200. In some embodiments, one of the panels 212*a,b* does not include an opening 218*a,b*, such that the blower 200 includes a single inlet 208. Opening(s) 218*a,b* may be any appropriate size.

The top panel 212*a* and bottom panel 212*b* each have a curved edge 220*a,b* and a straight edge 222*a,b*. The bottom panel 212*b* may have a shape that is similar to that of the top panel 212*a*. For example, the bottom panel 212*b* may have a shape that is a mirror image of the top panel 212*a* (i.e., where the mirror plane is parallel to straight edges 222*a,b*). As described in greater detail with respect to FIGS. 3A,B and 4 below, the dimensions of the curved edges 220*a,b* of the top and bottom panels 212*a,b* are selected to improve performance of the blower 200. For example, an expansion angle (e.g., expansion angle 356 of FIG. 3B) defining the dimensions of curved edges 220*a,b* may vary as a function of distance (or angular position) along the length of the curved edges 220*a,b*.

The connecting panel 214 is a curved piece in the approximate shape of a curved rectangle. The connecting panel 214 has two straight edges 224, 226 and two curved edges 228*a,b*. First curved edge 228*a* runs parallel to second curved edge 228*b* of the connecting panel 214. To form the housing 202, curved edge 228*a* of the connecting panel 214 is attached (e.g., welded together, attached with bolts or any other appropriate fastener) to the curved edge 220*a* of the top panel 212*a*, and curved edge 228*b* of the connecting panel 214 is attached to the curved edge 220*b* of the bottom panel 212*b*. The straight edges 222*a,b*, 224, 226 form an opening in the housing 202. The cutoff plate 216 may define a lower edge 230 of the outlet 210 of the blower 200. The dimensions of this opening may be decreased to the desired size of outlet 210 by positioning the cutoff plate 216 in the housing 202, which defines the bottom edge 230 of the outlet 210, as illustrated in FIG. 2B. When the top panel 212*a* and bottom panel 212*b* are connected to the connecting panel 214, as shown in FIG. 2B, their corresponding curved edges 220*a,b* extend from the bottom edge 226 of the connecting panel 214 to the top edge 224 of the connecting panel 214.

Figure 2D:
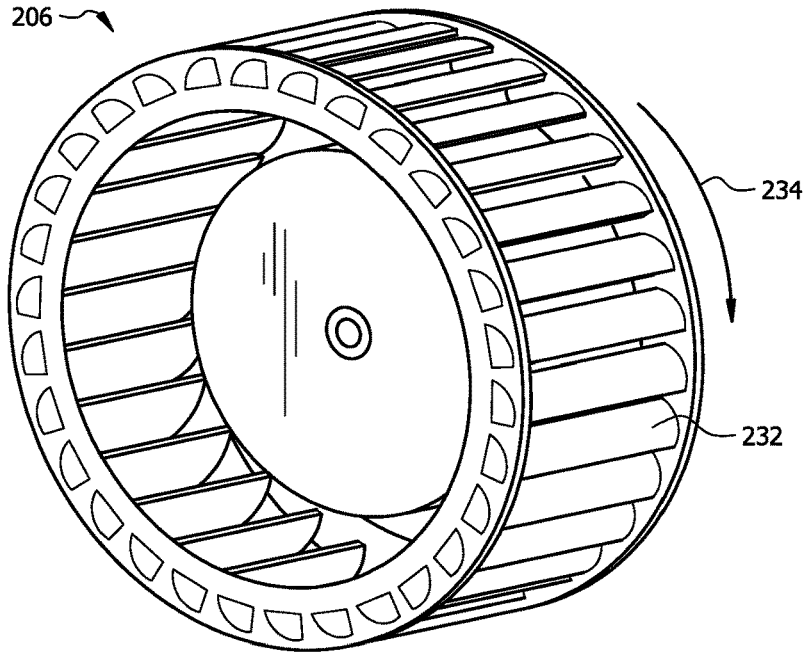
FIG. 2D is a diagram showing a blower wheel of the blower of FIG. 2A.

FIG. 2D illustrates an example blower wheel 206 of the example blower 200 in greater detail. The blower wheel 206 shown in FIG. 2D is a forward-curved blower wheel. The blower wheel 206 is a cylindrical structure with blades 232 arranged perpendicular to the direction of rotation 234 (e.g., along a direction parallel to an angular momentum of the blower wheel 206 when it rotates). The blades 232 are curved in the direction of rotation 234. In other embodiments, the blower wheel 206 may be a backward-curved blower wheel, and the blower 200 may be a backward-curved blower.

Figure 3A:
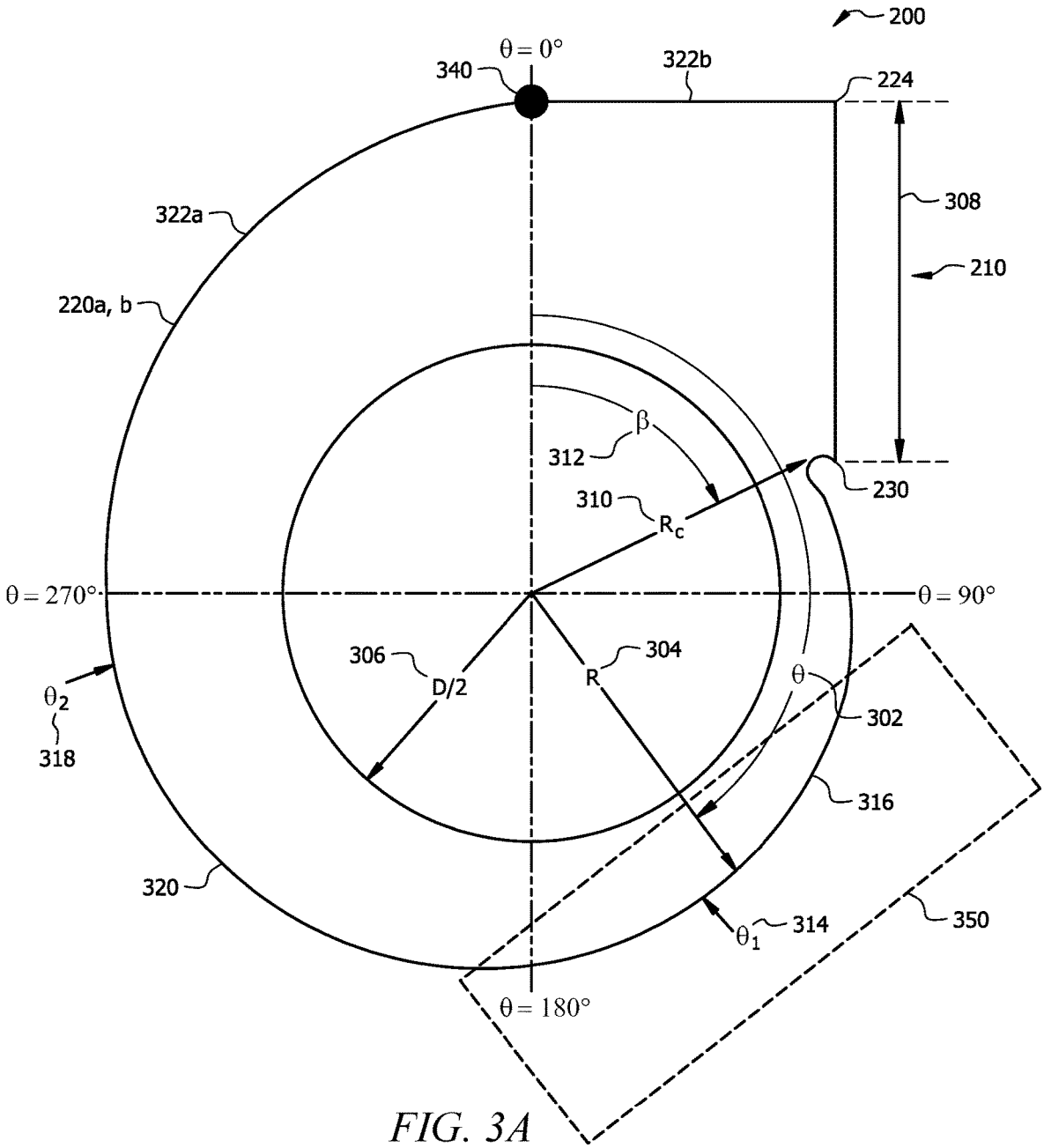
FIG. 3A is a diagram showing a cross-sectional view of the blower of FIG. 2A.
Figure 3B:
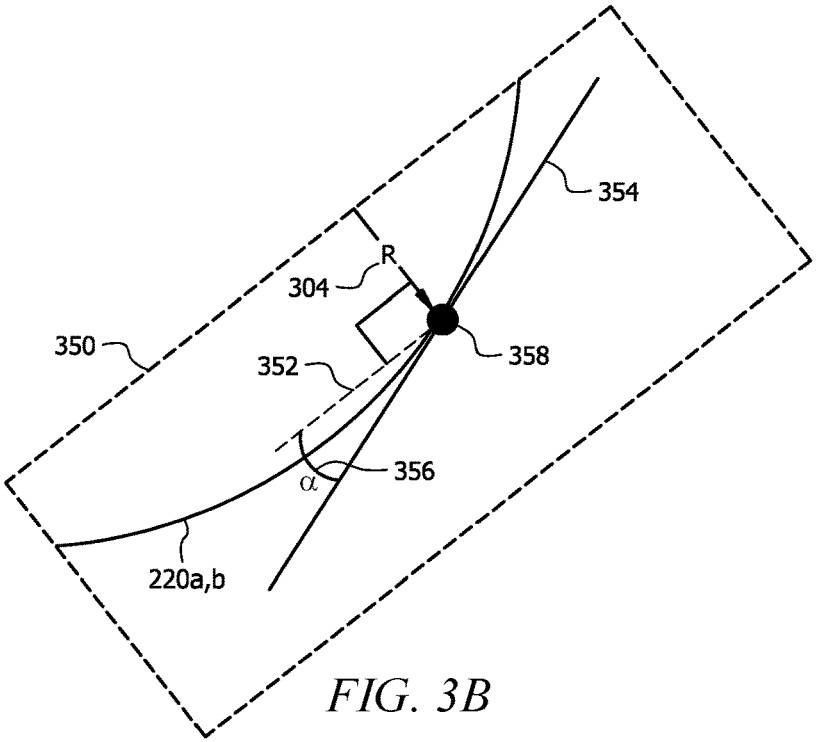
FIG. 3B is a diagram showing an expanded view of the cross-sectional view of FIG. 3A.

FIG. 3A illustrates a cross section view of an example blower 200. FIG. 3B shows an expanded view of region 350 of FIG. 3A. FIGS. 3A,B illustrate the shape of the top panel 212*a* and bottom panel 212*b* of the housing 202 in greater detail. In FIG. 3A, an angular position 302 (θ) can be used define location along the curved edges 220*a,b* of the top and bottom panels 212*a,b*. Angular position 302 may be defined relative to a top point 340 of the blower 200. The top point 340 may correspond to a position along the curved edge 220*a,b* where the edge becomes straighter (e.g., with an expansion angle 356 near zero, see FIG. 3B) leading to outlet 210 of the blower 200. Angular position 302 may be defined relative to top point 340 in a clockwise direction (e.g., in the direction of rotation 234 of the forward blower wheel 206). Arc length 304 (R) is the distance from the center of the blower wheel 206 to the curved edge 212*a,b* of the blower housing 202. As such, arc length 304 is a measure defining the shape of the panels 212*a,b* of the housing 202.

In the example of FIG. 3A, the blower wheel 206 has a radius 306 that is half the diameter (D) of the blower wheel 206.

The outlet 210 has a height 308, which is the distance from the lower edge 230 of the outlet 210 (e.g., from cutoff plate 216) to upper edge 224 of the connecting panel 214. A width of the outlet 210 corresponds to about the width of the connecting panel 214. A cutoff plate angle 312 (β) is the angle at which a cutoff radius 310 (Rc) aligns with the cutoff plate 216 (i.e., at the lower edge 230 of the outlet 210 of the blower 200). As an example, the cutoff plate angle 312 may be between 45° and 90°. In some embodiments, the cutoff plate angle is about 78°. The cutoff radius 310 is the distance from the center of the blower wheel 206 to the lower edge 230 (e.g., cutoff plate 216) of the housing 200 (see FIGS. 2B,C). As an example, the cutoff radius 310 may be about half the diameter of the blower wheel 206 (e.g., about 0.57 times the diameter of the blower wheel 206)

In the new blower 200 and blower housing 202 of this disclosure, the arc length 304 (e.g., or the expansion angle 356 of FIG. 3B defining the arc length 304), which defines the shape of housing 202, is varied along the length of the curved edges 220*a,b* (or at different values of angular position 302) to improve performance of the blower 200. For example, the arc length 304 (or expansion angle 356 of FIG. 3B) may change as a function of angular position 302. For instance, arc length 304 (or expansion angle 356 of FIG. 3B) may have a different value along different portions 316, 320, 322*a,b* of the curved edges 220*a,b* of the housing 202. The different portions 316, 320, 322*a,b* of the curved edges 220*a,b* may be defined by angular positions 314, 318 and/or the cutoff plate angle 312 and top point 340. For example, from the cutoff plate angle 312 up to a first angular position 314 corresponding to edge portion 316, the arc length 304 may be a first value (e.g., 0.57×the diameter of the blower wheel 206). The arc length 304 may correspond to an expansion angle (see expansion angle 356 of FIG. 3B) in this edge portion 316. The first angular position 314 may be in a range from 140° to 180° (e.g., 160°) from top point 340 of the housing 202. From the first angular position 314 to a second angular position 318 (e.g., in a range from 230° to 270°, e.g., of about 250°) corresponding to edge portion 320, the arc length 304 may be a second value (e.g., 0.93×the diameter of the blower wheel 206). From the second angular position 318 to the top point 340 (e.g., 250°<θ<360°) corresponding to edge portion 322*a*, the arc length 304 may be a third value (e.g., 0.96×the diameter of the blower wheel 206). At the remaining edge portion 322*b* (e.g., θ>360°), the arc length 304 may be the same value as for edge portion 322*a* or the edge portion 322*b* may become flat, as illustrated in FIG. 3A (e.g., to fit the blower 200 fits in an available space).

In some embodiment, the arc length 304 may be defined by a linear correlation of the form R=mθ+c, where R is the arc length 304, m is a value that changes as a function of angular position 302 (see TABLE 1 below), θ is angular position 302, and c is a constant value.

TABLE 1

Example values of m for determining arc length 304 as a function of angular position 302

| Range of angular position 302 (θ) | Range of possible values of m |
|---|---|
| Cutoff angle 312 (β) to 160° | 0 to 0.04 |
| 160° to 250° | 0.38 to 0.48 |
| 250° to 360° | 0.02 to 0.08 |

In some embodiment, the arc length 304 may be defined as a function of an expansion angle of the curved edges 220*a,b* of the housing 202. FIG. 3B illustrates a region 350 of the blower cross section of FIG. 3A. An expansion angle 356 (*a*) at a given point 358 along the curved edge 220*a,b* of the housing 202 is defined as the angle between a line 352 normal to the arc length 304 at the point 358 and a line 354 tangent to the curved edge 220*a,b* at the point 358. The value of arc length 304 defining the shape of the housing 202 (i.e., of curved edges 220*a,b*) may be a function of the expansion angle 356. For example, the arc length 304 (R) may be determined according to:

$$R = R_0\left(1 + (\tan(\alpha)) \times (\theta - \theta_0)\frac{\pi}{180}\right)$$

where $R_0$ is a constant distance value (e.g., radius 306 of FIG. 3A), a is expansion angle 356, θ is angular position 302, and $\theta_0$ is a constant angular position value (e.g., the cutoff plate angle 312 of FIG. 3A).

Figure 4:
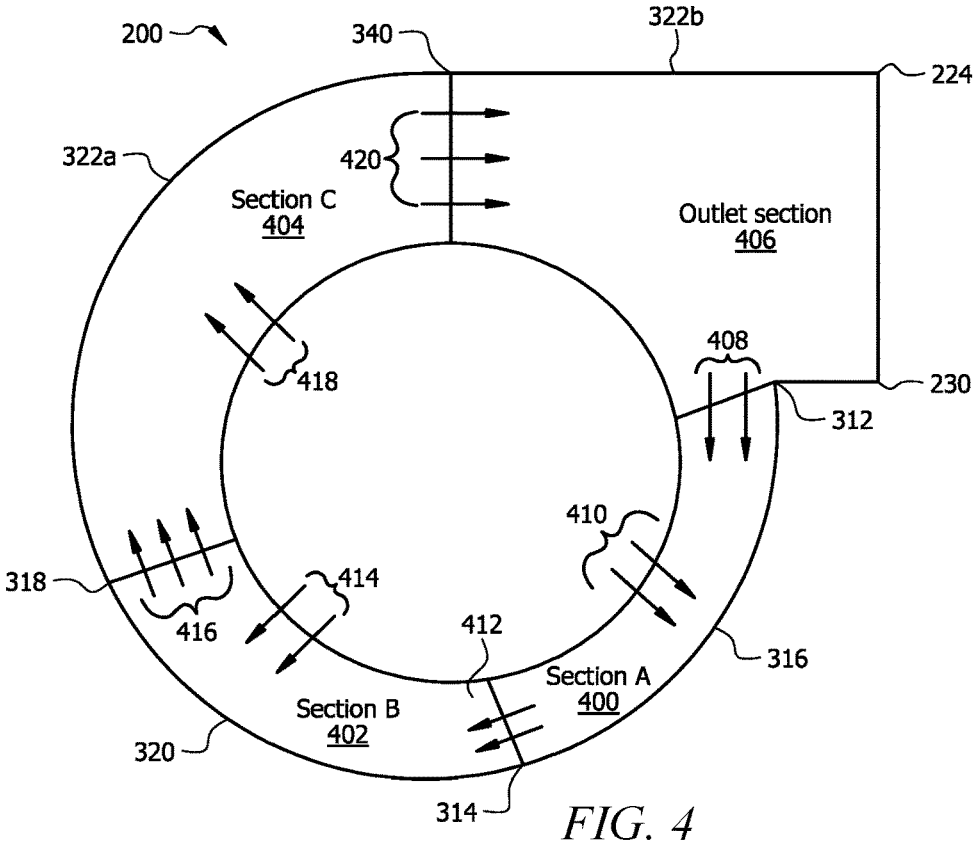
FIG. 4 is a diagram illustrating one embodiment of an operation of the blower of FIG. 2A.

FIG. 4 provides an illustration of the blower 200 in operation. During operation, blower 200 pulls air 410, 414, 418 (e.g., corresponding to airflow 124 of FIG. 1) is pulled into the blower 200 and provided as airflow 420 (e.g., corresponding to airflow 118 of FIG. 1). Operation of the blower 200 is described in four different sections 400, 402, 404, 406 that are sized and/or shaped to improve performance of the blower 200, as described further below.

The first section 400 (Section A of FIG. 4) of the blower 200 extends along the first portion 316 of the distance from edge 230 of the outlet 210 along the curved edge 220*a,b* of the housing 202. For example, the first section 400 may extend from the edge 230 of the outlet 210 (e.g., associated with cutoff plate angle 312 of FIG. 3A) to the first angular position 314 illustrated in FIG. 3A. The arc length 304 and expansion angle 356 in the first section 400 may be a relatively small value (e.g., as determined, as described above, as a function of angular position 302, such as an angle-dependent fraction of the diameter of the blower wheel 206, as a function of an angle-dependent slope (m), as a function of the expansion angle 356). The first section 400 receives air 408 and 410. The first section 400 provides suction, such that any air 416 not provided as airflow 118 (see FIG. 1) is pulled into section 402 as air 408, and is sized to at least avoid the reversal of airflow by the blower 200. In this initial section 400, the expansion angle is a relatively small value in a range from about −1.5° to about 1.5°. The arc length 304 in the first section 400 may be about 50% (e.g., 57%) of the diameter of the blower wheel 206. This disclosure recognizes that the size of the first section 400 can be decreased relative to previous technology without significantly impacting blower performance.

The second section 402 (Section B of FIG. 4) of the blower 200 extends along the second portion 320 of the distance from the end of the first section 400 along the curved edge 220*a,b* of the housing 202. For example, the second section 402 may extend from the first angular position 314 to the second angular position 318. The arc length 304 and expansion angle 356 in the second section 402 may be a relatively large value (e.g., as determined as described above as a function of angular position 302, such as an angle-dependent fraction of the diameter of the blower wheel 206, as a function of an angle-dependent slope (m), as a function of the expansion angle 356). For example, the expansion angle 356 of the curved edge 220*a,b* may be a larger value in second section 402 than it is in either of the first section 400 or the third section 404. The second section 402 receives air 412 from the first section 400 and air 414 (e.g., part of airflow 124 of FIG. 1). The second section 402 increases the pressure of this received air 412, 414. In the second section 402, the expansion angle is a relatively large value in a range from about 18° to about 22°. This corresponds to the section 404 having a larger volume than the first section 400 and a volume that increases more rapidly with increasing angular position 302 (see FIG. 3A). The arc length 304 in the second section 402 may be about 90% (e.g., 93%) of the diameter of the blower wheel 206. This disclosure recognizes that the size of the second section 402 plays an important role in increasing the pressure of air 412, 414. As such, the second section 402 is increased in size to improve performance in this portion of the blower 200. Since the size of the first section 400 and/or third section 404 are decreased, the performance of the blower 200 can be improved without increasing the size of the blower 200.

The third section 404 (Section C of FIG. 4) of the blower 200 extends along the third portion 322*a* of the distance from the end of the second section 402 until the top point 340. For example, the third section 404 may extend from the second angular position 318 to the outlet 210 of the blower 200 to the top point 340, corresponding to edge portion 322*a*. The expansion angle 356 in the third section 404 may be a relatively small value. The third section 404 receives air 416 from the second section 402 and air 418 (e.g., as part of airflow 124 of FIG. 1). The third section 404 primarily diverts air 416 in the desired direction (e.g., into outlet section 406 and into duct 128 of FIG. 1). In the third section 404, the expansion angle is a relatively small value in a range from about 1° to about 3°. The arc length 304 in the third section 404 may be about 90% (e.g., 96%) of the diameter of the blower wheel 206. This disclosure recognizes that the third section 404 plays a relatively small role in pressurizing the air 124 to be provide by the blower 200 as airflow 118 (see FIG. 1).

The outlet section 406 extends from top point 340 to the end of the curved edge 220*a,b* of the housing 202, corresponding to edge portion 322*b*. The expansion angle 356 in the outlet section 406 may be the same as or smaller than that of the third section 404. For example, edge portion 322*b* in the outlet section 406 may be relatively straight. This may allow the blower 200 to fit within available space (e.g., within duct 126 of FIG. 1)

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

What is claimed is:

1. A blower for a heating, ventilation and air conditioning system, comprising:
- an air inlet;
- an air outlet;
- a blower wheel comprising blades;
- a motor operable to cause the blower wheel to rotate; and
- a blower housing within which the blower wheel is positioned, wherein:
  - the blower housing comprises a top panel, a bottom panel, and a connecting panel, wherein the top panel and the bottom panel are connected to the connecting panel;
  - the top panel comprises a curved edge extending from a bottom edge of the connecting panel to a top edge of the connecting panel, wherein an expansion angle of the curved edge of the top panel changes as a function of angular position along the curved edge of the top panel; and
  - the curved edge of the top panel comprises a first section with a first expansion angle, wherein the first section extends from a lower edge of the air outlet to a first angular position along the curved edge of the top panel, and wherein the first expansion angle is in a range from −1.5° to 0°.

2. The blower of claim 1, wherein the expansion angle, at a location along the curved edge of the top panel, is an angle between (1) a first line normal to a line extending from a center of the blower wheel to the location and (2) a second line tangent to the curved edge at the location.

3. The blower of claim 1, wherein:
- the connecting panel comprises a first curved edge and a second curved edge parallel to the first curved edge;
- the curved edge of the top panel is attached to the first curved edge of the connecting panel; and
- a curved edge of the bottom panel is attached to the second curved edge of the connecting panel.

4. The blower of claim 1, wherein the curved edge of the top panel further comprises:
- a second section with a second expansion angle, wherein the second section extends from the first angular position to a second angular position along the curved edge of the top panel; and
- a third section with a third expansion angle, wherein the third section extends from the second angular position to an upper point of the curved edge.

5. The blower of claim 4, wherein the first angular position corresponds to an angle in a range from 140° to 180° from a top point of the blower housing.

6. The blower of claim 4, wherein the second angular position corresponds to a position at an angle in a range from 230° to 270° from a top point of the blower housing.

7. The blower of claim 4, wherein the second expansion angle is greater than both the first expansion angle and the third expansion angle.

8. The blower of claim 4, wherein the second expansion angle is in a range from 18° to 22°.

9. The blower of claim 4, wherein the third expansion angle is in a range from 1° to 3°.

10. A blower housing for a blower of a heating, ventilation and air conditioning system, comprising:

a top panel;

a bottom panel; and a connecting panel, wherein:

the top panel and the bottom panel are connected to the connecting panel;

the top panel comprises a curved edge extending from a bottom edge of the connecting panel to a top edge of the connecting panel, wherein an expansion angle of the curved edge of the top panel changes as a function of angular position along the curved edge of the top panel; and the curved edge of the top panel comprises a first section with a first expansion angle, wherein the first section extends from a lower edge of an air outlet of the blower housing to a first angular position along the curved edge of the top panel, and wherein the first expansion angle is in a range from −1.5° to 0°.

11. The blower housing of claim 10, wherein the expansion angle, at a location along the curved edge of the top panel, is an angle between (1) a first line normal to a line extending from a center of a blower wheel position within the blower housing to the location and (2) a second line tangent to the curved edge at the location.

12. The blower housing of claim 10, wherein:

the connecting panel comprises a first curved edge and a second curved edge parallel to the first curved edge;

the curved edge of the top panel is attached to the first curved edge of the connecting panel; and a curved edge of the bottom panel is attached to the second curved edge of the connecting panel.

13. The blower housing of claim 10, wherein the curved edge of the top panel further comprises:

a second section with a second expansion angle, wherein the second section extends from the first angular position to a second angular position along the curved edge of the top panel; and a third section with a third expansion angle, wherein the third section extends from the second angular position to an upper point of the curved edge.

14. The blower housing of claim 13, wherein the first angular position corresponds to an angle in a range from 140° to 180° from a top point of the blower housing.

15. The blower housing of claim 13, wherein the second angular position corresponds to a position at an angle in a range from 230° to 270° from a top point of the blower housing.

16. The blower housing of claim 13, wherein the second expansion angle is greater than both the first expansion angle and the third expansion angle.

17. The blower housing of claim 13, wherein the second expansion angle is in a range from 18° to 22°.

18. A heating ventilation, and air conditioning (HVAC) system comprising:

an evaporator configured to transfer heat from refrigerant to a flow of air across the evaporator; and a blower configured to provide the flow of air across the evaporator, the blower comprising:

an air inlet operable to receive return air;

an air outlet operable to allow the flow of air to be provided out of the blower;

a blower wheel comprising blades;

a motor operable to cause the blower wheel to rotate; and a blower housing within which the blower wheel is positioned, wherein:

the blower housing comprises a top panel, a bottom panel, and a connecting panel, wherein the top panel and the bottom panel are connected to the connecting panel; and the top panel comprises a curved edge extending from a bottom edge of the connecting panel to a top edge of the connecting panel, wherein an expansion angle of the curved edge of the top panel changes as a function of angular position along the curved edge of the top panel, wherein the curved edge of the top panel comprises:

a first section with a first expansion angle, wherein the first section extends from a lower edge of the air outlet to a first angular position along the curved edge of the top panel, and wherein the first expansion angle is in a range from −1.5° to 0°;

a second section with a second expansion angle, wherein the second section extends from the first angular position to a second angular position along the curved edge of the top panel, wherein a second region of the blower that is interposed between the second section and the blower wheel has a greater volume than a first region of the blower that is interposed between the second section and the blower wheel; and a third section with a third expansion angle, wherein the third section extends from the second angular position to an upper point of the curved edge.

* * * * *